US008657459B2

(12) United States Patent
Janice et al.

(10) Patent No.: US 8,657,459 B2
(45) Date of Patent: Feb. 25, 2014

(54) LIGHTING APPARATUS

(75) Inventors: Gregory C. Janice, Shamong, NJ (US); Michael Aaskov, Hampton Falls, NH (US); Kyle Walters, Cambridge, MA (US)

(73) Assignee: Princeton Tectonics, Inc., Bordentown, NJ (US)

( * ) Notice: Subject to any disclaimer, the term of this patent is extended or adjusted under 35 U.S.C. 154(b) by 223 days.

(21) Appl. No.: 13/350,933

(22) Filed: Jan. 16, 2012

(65) Prior Publication Data

US 2012/0182724 A1 Jul. 19, 2012

Related U.S. Application Data

(60) Provisional application No. 61/433,304, filed on Jan. 17, 2011.

(51) Int. Cl.

| | |
|---|---|
| ***F21L 4/02*** | (2006.01) |
| ***F21V 31/00*** | (2006.01) |
| ***F21V 21/14*** | (2006.01) |
| ***F21V 21/32*** | (2006.01) |

(52) U.S. Cl.

USPC ..... 362/158; 362/183; 362/184; 362/190; 362/191; 362/198

(58) Field of Classification Search

USPC ..... 362/157–208

See application file for complete search history.

(56) References Cited

U.S. PATENT DOCUMENTS

| | | | | |
|---|---|---|---|---|
| 3,924,116 | A * | 12/1975 | Brindley | 362/158 |
| 3,924,117 | A * | 12/1975 | Brindley | 362/191 |
| 4,940,860 | A * | 7/1990 | Shiau | 200/60 |
| 8,545,040 | B2 * | 10/2013 | Berken | 362/184 |

* cited by examiner

*Primary Examiner* — Stephen F Husar
*Assistant Examiner* — James Cranson, Jr.
(74) *Attorney, Agent, or Firm* — Howson & Howson LLP

(57) ABSTRACT

A low profile lighting apparatus is characterized by a battery housing, a rail-engaging plate connected to the housing by a pair of arms, and a recessed activating push-button located between the arms and adjacent the rail-engaging plate. A flexible resilient tab, also recessed between the arms, secures the apparatus to a rail. A lock-out switch is built into a plug for closing an end of the housing. The plug has three discrete rotational positions, one for attachment, a second for activation of an illumination source, and a third for preventing accidental activation of the illumination source by requiring simultaneous axial pressure and rotation. Instead of the plug, a hinged door having a sliding latch part can be utilized. The sliding latch part includes a pair of resilient legs that cooperate with surfaces inside the door to urge the latch part toward a latching condition.

20 Claims, 3 Drawing Sheets

LIGHTING APPARATUS

CROSS-REFERENCE TO RELATED APPLICATION

This application claims priority on the basis of provisional application 61/433,304, filed Jan. 17, 2011.

FIELD OF THE INVENTION

This invention relates to lighting, and in particular to a personal, battery-powered, light adapted to be worn by an individual on headgear or on an article of clothing, or to be mounted removably on a surface of an article.

BACKGROUND OF THE INVENTION

There has been a need for reliable, light-weight devices to provide illumination for use by individuals in order to read or perform work at night or when situated in locations such as in tunnels, caves and the like where insufficient light is available. Such lighting devices have both civilian and military applications, and various personal lighting devices have been proposed. These include devices that can be fastened to headgear, to belts or straps, to articles of clothing, to weapons, and to surfaces of other articles.

In military applications, especially in combat, it can be important for an individual to avoid revealing his or her location inadvertently to an enemy combatant. Consequently, there is also a need for a lighting device that can be disabled by the user and in which accidental activation is reliably prevented.

In military and other applications, it is also very desirable for the personal lighting device to be readily attached to, and detached from, a helmet or other article, and to be at the same time compact and not easily dislodged or damaged by accidental contact with other objects.

In some applications of a personal lighting device it is also desirable to provide for a moisture-tight, but easily operated, closure on the device's battery compartment.

SUMMARY OF THE INVENTION

The lighting apparatus according to the invention is designed to provide a compact and reliable source of illumination that is particularly resistant to accidental activation but nevertheless easy to use. A preferred embodiment of the invention is a low profile lighting apparatus characterized by a battery housing, a rail-engaging plate spaced from the housing and connected to the housing by a pair of arms, and a recessed activating push-button located between the arms and adjacent the rail-engaging plate.

In one broad aspect, the lighting apparatus according to the invention comprises a housing containing an electrochemical source of electric current, an illumination source connected to the housing, and a control connected to the housing for switching electric current supplied by the electrochemical source within the housing to the illumination source. The apparatus also includes an arm structure comprising first and second arms fixed to the housing and extending therefrom in spaced, substantially parallel, relation to each other. A mounting element, connected to the arm structure, is provided for engaging a supporting rail. The mounting element is situated on a first side of the arm structure, at a location spaced from the housing. The control includes a switch supported by the arm structure and disposed between the arms. The switch includes a push-button recessed from a second side of the arm structure opposite from the first side. The push-button is manually accessible for operation by insertion of a finger into a space between the arms. Electrical connections are provided between the switch and the housing for delivery of electric current from the electrochemical source, through the switch, to the illumination source.

In a preferred embodiment, the arm structure, the mounting element, and the switch together define a water-tight, sealed, compartment for containing at least parts of the electrical connections. Optionally, the mounting element can be in the form of a plate attached to the arm structure to form a closure for the compartment.

The housing is preferably substantially in the shape of an elongated circular cylinder, with the illumination source connected to the housing at one end of the cylinder. The electrochemical source is an electrochemical cell located within the housing, and the control preferably includes a second switch located at an opposite end of the cylinder. The second switch can have a first position in which delivery of electric current to the illumination source is permitted and a second position in which delivery of electric current to the illumination source is disabled. Where the housing is substantially in the shape of an elongated circular cylinder and the illumination source is connected to the housing at one end of the cylinder, the cylinder can have a removable plug at its end opposite from the end to which the illumination source is connected. The electrochemical source can be an electrochemical cell located within the housing, and a spring, mounted on the plug, can be in contact with the electrochemical cell. In this embodiment, the second switch can be constituted by a first contact fixed to the plug and connected to the spring, and a second contact fixed to the cylinder. The plug can be rotatable and can include a radial pin cooperating with a circumferential slot in the cylinder, the slot having an opening for allowing axial passage of the pin for removal and attachment of the plug when the plug is rotated to a first rotational position, a first detent for engaging the pin and thereby holding the plug against rotation when the plug is rotated to a second rotational position, and a second detent for engaging the pin and thereby holding the plug against rotation when the plug is rotated to a third rotational position. The contact fixed to the plug and the contact fixed to the cylinder can be in contact with each other when the plug is in its third rotational position, and out of contact with each other when the plug is in its second rotational position. The pin is disengageable from the detents for rotation by movement along an axis extending from one end of the cylinder to the other end of the cylinder, preferably against an axial force exerted by said spring. The illumination source can comprise plural light-emitting diodes.

A flexible locking tab is preferably disposed between the arms for engaging a locking notch on a supporting rail to prevent movement of the lighting apparatus along the rail.

Cross-sections of the mounting element transverse to a first direction preferably have an external dovetail-shaped cross-section capable of sliding engagement with an undercut dovetail-shaped slot in a rail.

According to another broad aspect of the invention an opening is provided in the housing for insertion and removal of the electrochemical source. A door, hinged to the housing, is provided for closing the opening. A latch for maintaining the door in a closed condition comprises a slot formed on a part of the housing, and a movable latch part mounted for sliding movement in the door and having a protrusion extending in a first direction relative to said door and receivable in the slot.

The movable latch part, which can be formed as a unitary molded part, comprises a pair of resilient legs extending along a second direction opposite to said first direction, in opposed, spaced relation to each other. The movable latch part has a pair of oppositely facing surfaces, composed of surface on each leg. These surfaces can face away from each other. A guide formed in the door constrains the movable latch part for linear movement relative to the door along the aforementioned first and second directions. The guide includes a pair of spaced, surfaces respectively engaged with the oppositely facing surfaces of the movable latch part. The surfaces of the guide exert forces on the legs causing the legs to be bent resiliently. At least the surfaces of one of the two pairs of surfaces are disposed in oblique relation to the first and second directions such that the forces exerted on the legs of the latch part by the surfaces of the guide produce a resultant force that urges the movable latch part in the first direction such that its protrusion is maintained in the slot. A manually operable slide, extending through the door, is engageable with the movable latch part, allowing the movable latch part to be urged in the second direction against the resultant force, for releasing the protrusion from the slot.

A sealing ring is provided to establish a fluid-tight seal between the door and the housing for sealing the compartment containing the electrochemical source. The sealing ring fits an interface between the door and the housing at the location of the opening of the housing when the door is in its closed condition. The sealing ring can be disposed in an annular groove formed in a circumferential surface of the door, and is movable with the door.

Among the advantages of the various aspects of the lighting device is the fact that its operating push button is recessed and therefore resistant to accidental activation. The lighting device has another significant advantage when the battery compartment plug is used as a "lock-out" switch for intentional disablement of the illumination source by rotation of the plug to a lock-out position. The recessed locking tab also provides for secure and reliable attachment to a mounting rail while making the device readily removable when the user intends to remove it. Other advantages of various aspects of the invention include structural simplicity, water-resistance, small size, ease of use, and resistance to accidental detachment from a mounting device. The embodiment having the hinged door exhibits other advantages, including superior sealing of the battery compartment, and simplicity and reliability of the door latch mechanism.

Further objects and advantages of the invention will be apparent from the following description when read in conjunction with the drawings.

DETAILED DESCRIPTION OF THE PREFERRED EMBODIMENTS

Figure 2:
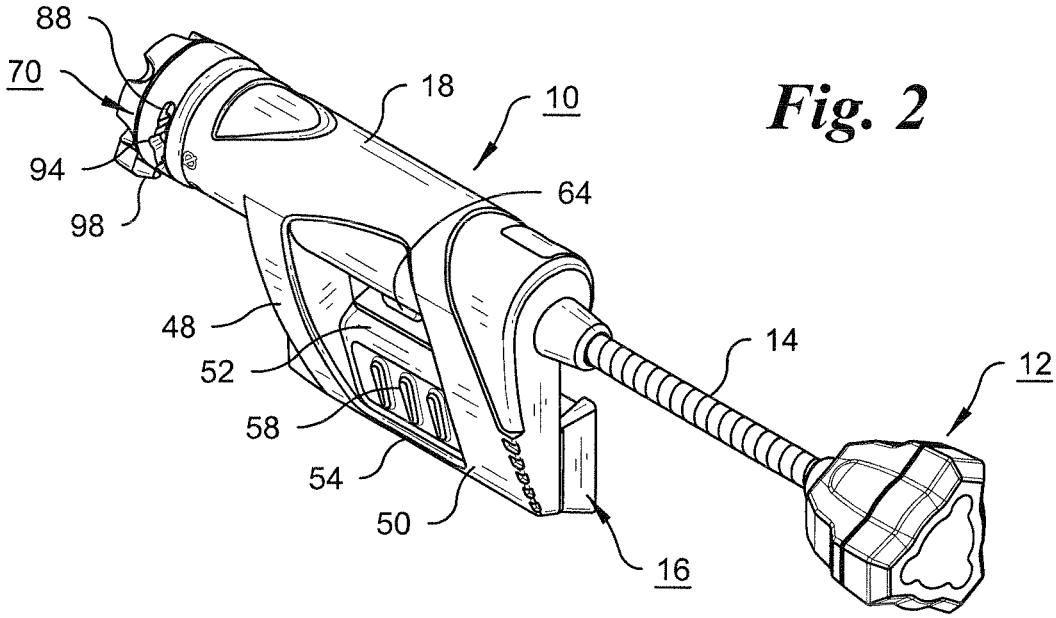
FIG. 2 is an oblique perspective view showing a side thereof on which a manually operable push-button is provided.
Figure 3:
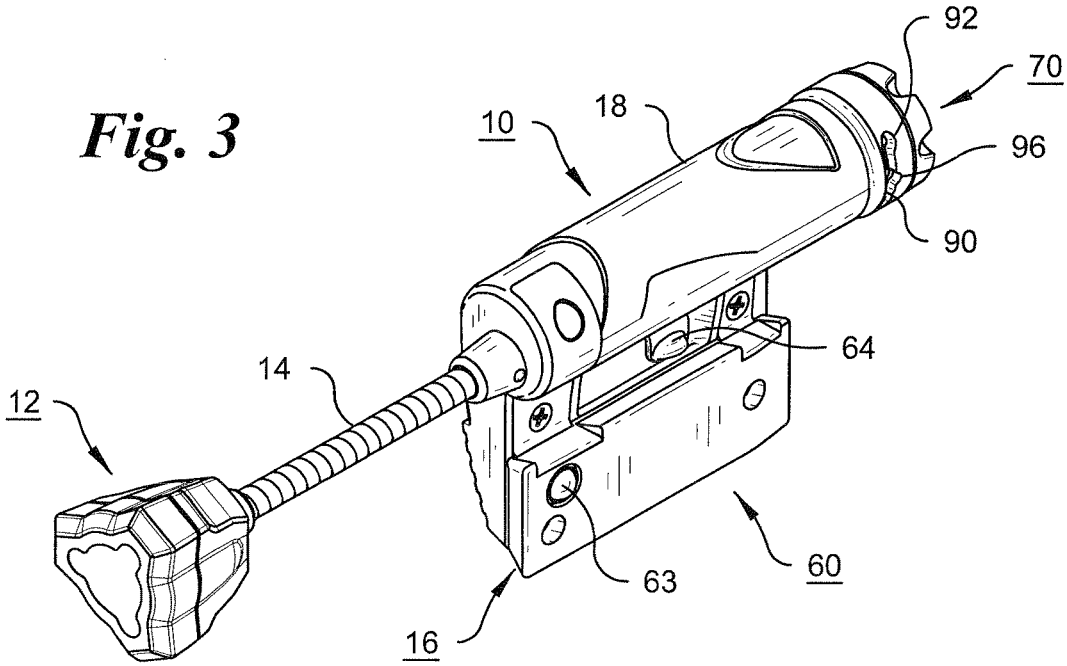
FIG. 3 is another oblique perspective view showing a side thereof on which a rail-engaging member is provided.

As shown in FIGS. 2 and 3, the principal components of the lighting apparatus are its housing 10, its illumination source 12, a flexible "gooseneck" sheath 14 extending from one end of the housing to the illumination source, and a mounting element 16 by which the housing can be attached to a supporting rail (not shown).

Figure 1:
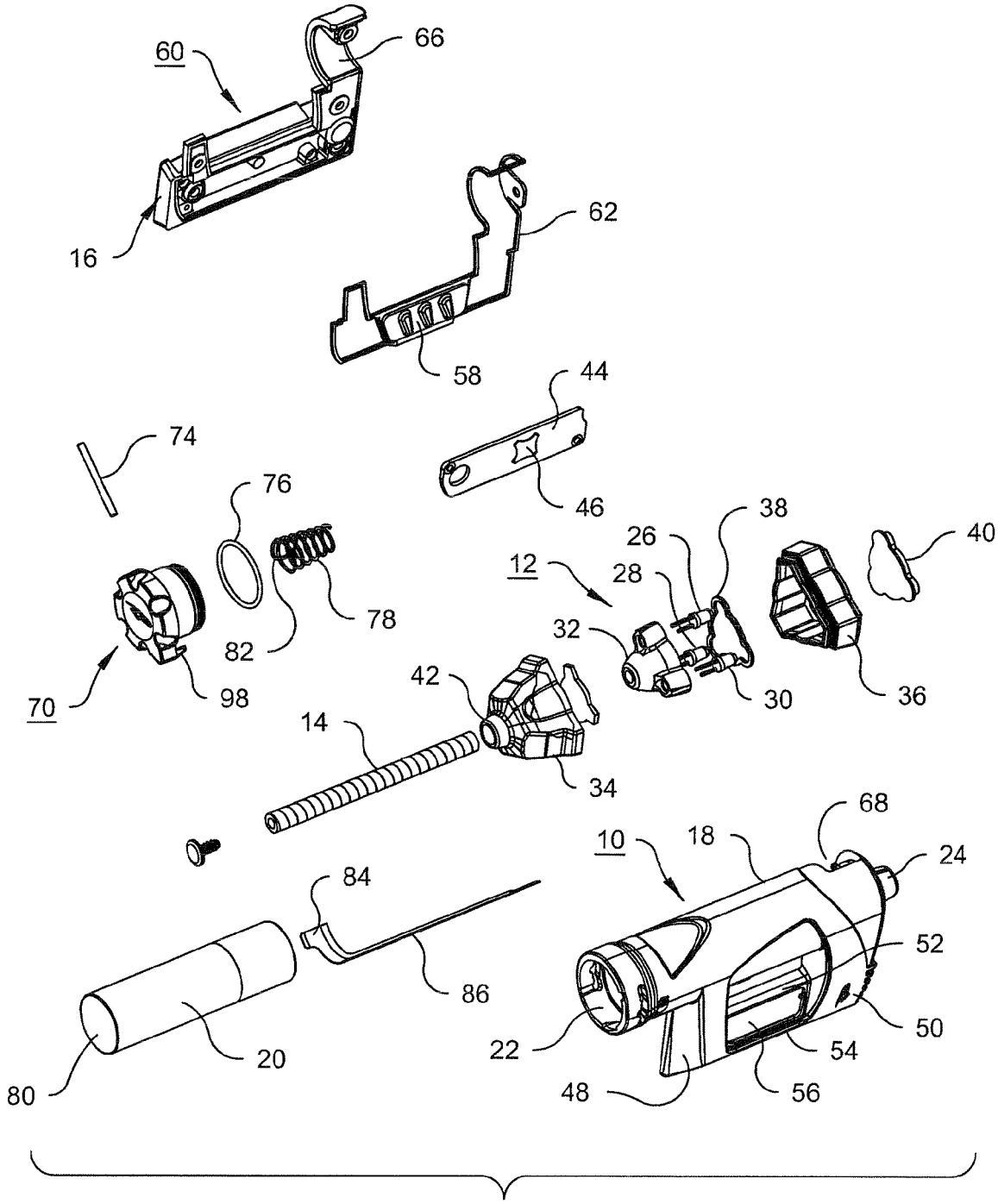
FIG. 1 is an exploded view of an embodiment of a lighting apparatus according to the invention.

The housing 10 can be composed of any of various materials, but is preferably molded from a suitable resin such as ABS or polyamide. As shown in FIG. 1, the housing is preferably in the form of an elongated, substantially circular, cylindrical body 18 having a hollow interior for containing an electrochemical current source such as a conventional 1.5 volt "AA" cell 20. The housing has an opening 22 at one end for receiving the AA cell 20, and a fitting 24 at its opposite end for attachment of the gooseneck sheath 14.

The illumination source can include one or more light-emitting diodes (LEDs). In the embodiment shown, the illumination source 12 includes three such LEDs 26, 28 and 30, secured in a support 32. The LEDs and the support are enclosed within a head composed of a rear shell 34, a front shell 36, a gasket 38 and a transparent lens 40. The rear shell 34 includes a fitting 42, which is connected to the end of gooseneck 14 remote from housing 12.

The LEDs can be in any of various combinations. For example, one LED can emit white light, and the other two LEDs can emit light is different colors. Selection of the LEDs and control of their illumination intensity is preferably carried out by means of electronic circuitry on a printed circuit board 44, which responds to a sequence of depressions of a momentary switch 46 built on to the circuit board. A first depression of the switch, for example, can activate a red LED at a low level of illumination, subsequent, appropriately timed, depressions can produce various other illumination modes. After a suitable interval following a last depression of the switch, another depression of the switch can cause the illumination source to be switched off. A typical circuit for producing different illumination modes in response to depressions of a single set of contacts is described in U.S. Pat. No. 6,952,084, granted Oct. 4, 2005, the disclosure of which is incorporated by reference.

The housing 10 is provided with an arm structure comprising first and second arms 48 and 50, fixed to the cylindrical body 18 of the housing and extending downward therefrom in spaced, substantially parallel, relation to each other. Upper and lower connecting elements 52 and 54, which extend from one arm to the other, along with the arms define a rectangular opening 56, through which a flexible push button 58 is exposed, as shown in FIG. 2. It is through manual depression of push button 58 that a user can activate the contacts of circuit board switch 46, which is situated directly behind the flexible push button. As shown in FIG. 2, the push-button is in a recessed position between arms 48 and 50, and therefore resistant to accidental activation.

The flexible push button 58 cooperates with the arms 48 and 50, and with the connecting elements 52 and 54, to seal the opening 56 (FIG. 1). As shown in FIG. 1, a structure composed of arms 48 and 50 and connecting elements 52 and 54 forms a part of an circuit board compartment that is closed off by a closing member 60. A thin gasket 62, associated with the push-button 58, is situated between the closing member 60 and the structure composed of arms 48 and 50 and connecting elements 52 and 54 to provide a water-tight seal.

The closing member 60 includes mounting element 16, which is in the form of a plate the cross-sections of which, in planes transverse to the direction of elongation of the cylindrical housing body 18, have an external dovetail-shape whereby the plate is capable of sliding engagement with an undercut dovetail-shaped slot in a supporting rail (not shown). A spring-loaded ball 63 is incorporated into the plate to exert pressure on a wall of the rail in order to maintain the oblique edges of the plate in tight engagement with the undercut parts of the rail. Although the dove-tail shape is preferred for the mounting element, other shapes that match other supporting rail configurations can be adopted.

As shown in FIGS. 2 and 3, a resilient, flexible tab 64 depends from the cylindrical housing body. This tab is cooperable with locking slots (not shown) provided at intervals along a mounting rail, for securing the lighting apparatus against longitudinal movement along the rail. Tab 62 is recessed between arms 48 and 50 so that it is resistant to accidental operation, but readily accessible by the user for manual disengagement of the lighting apparatus from the mounting rail.

An upwardly extending part 66, generally in the shape of a question mark is provided at the forward end of the closing member 60. The curved portion of part 66 fits a correspondingly shaped slot 68 in the side of the cylindrical housing body 18 adjacent the forward end to close off a space through which electrical connections can be made between the circuit board, the illumination source, and the electrochemical source.

The opening 22 of the cylindrical housing body can be closed by a plug 70, to which is fixed a transverse pin 72 both ends of which protrude from the plug. The plug is provided with a sealing ring 76 which forms a water-tight seal with the interior wall of housing body 18. Also affixed to the plug is a metal coil spring 78, which presses against the negative terminal 80 of cell 20. The coil spring is fixed to the plug in such a way that it rotates with the plug. An end 82 of the spring serves as a switch contact, which can engage a part 84 of a metal contact element 86 affixed to the inner wall of the housing body.

The plug has three distinct rotational positions determined by cooperation of the protruding ends of pin 72 with a pair of circumferential slots 88 and 90 formed on opposite sides of the housing body adjacent the opening 22. In a fully counterclockwise rotational position the protruding ends of pin 72 are in register with longitudinal slots (not shown) extending from the opening 22 along the inner wall of the housing body. When the pins are in register with these longitudinal slots, the plug can be pushed manually into the slot, compressing spring 78, until the pin is in register with circumferential slots 88 and 90. With the pin in register with the circumferential slots, the plug can be rotated fully clockwise until the protruding parts of the pin reach the ends of the circumferential slots. When manual pressure on the plug is released, the spring pushes the plug slightly outward causing the pins to enter notches at the ends of the slots, one such notch being notch 92 seen in FIG. 3. Slot 88 has a similar notch. When the plug is in its fully clockwise position, the end 82 of the spring makes electrical contact with part 84 of element 86, enabling the lighting apparatus by making a connection to the negative terminal of cell 20.

The plug also has an intermediate rotational position, in which the protruding ends of pin 70 can be pressed by the spring 78 into notches 94 and 96 in circumferential slots 88 and 90, respectively, and thereby held against rotation unless a positive axial force and a rotational force are simultaneously exerted on the plug. While the plug is in its intermediate rotational position, the end 82 of the spring is out of contact with part 84 of element 86, thereby disabling the lighting apparatus altogether by depriving the circuit and the illumination source of electric current. Since the manipulation required to engage spring end 82 with part 84 is readily performed, but not easy to perform unintentionally, the intermediate position of the plug can be used as a "safety" or "lock-out" position, providing reliable assurance against accidental activation of the illumination source.

The positions of the protruding ends of ends of the pin may not be readily determinable. Accordingly, a pointer 98 formed on the plug can be used to indicate the pin positions visually or by feel.

Figure 4:
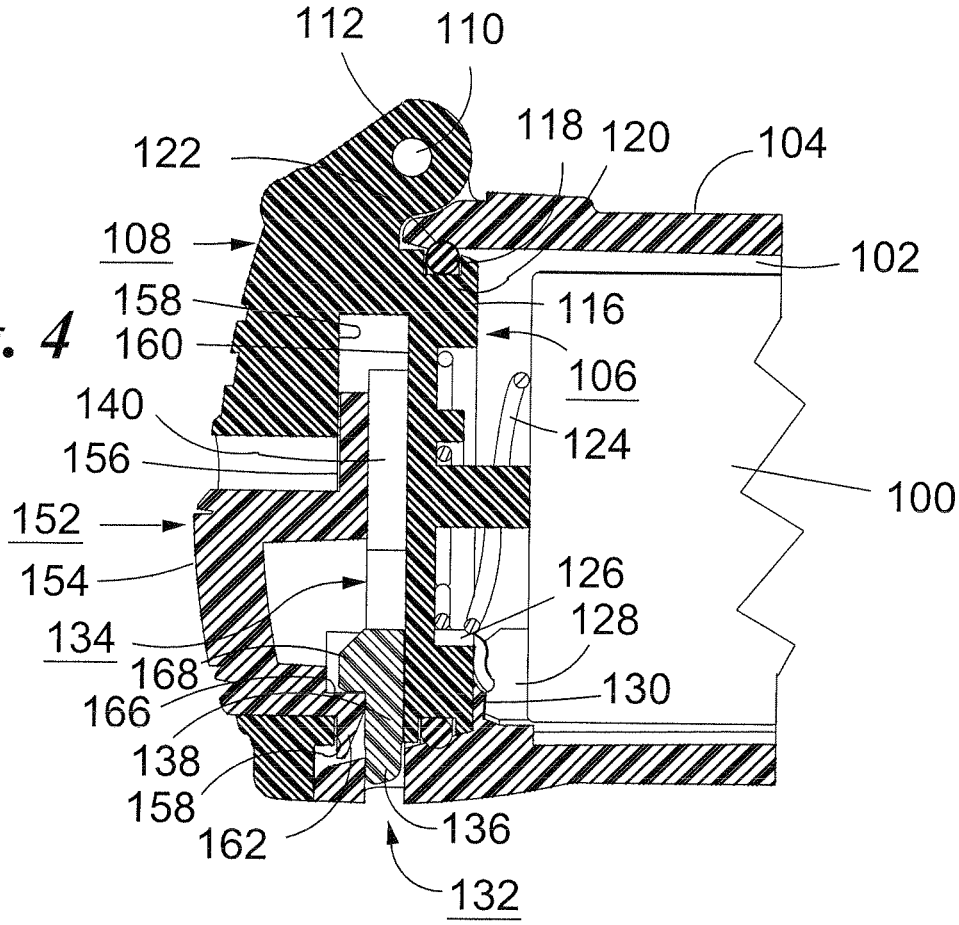
FIGS. 4 and 5 are cross-sectional views, taken respectively on a longitudinal plane and a transverse plane, of another embodiment of a lighting apparatus according to the invention, illustrating details of a hinged battery compartment door having a moisture-tight seal and a slide-operated latch mechanism.
Figure 5:
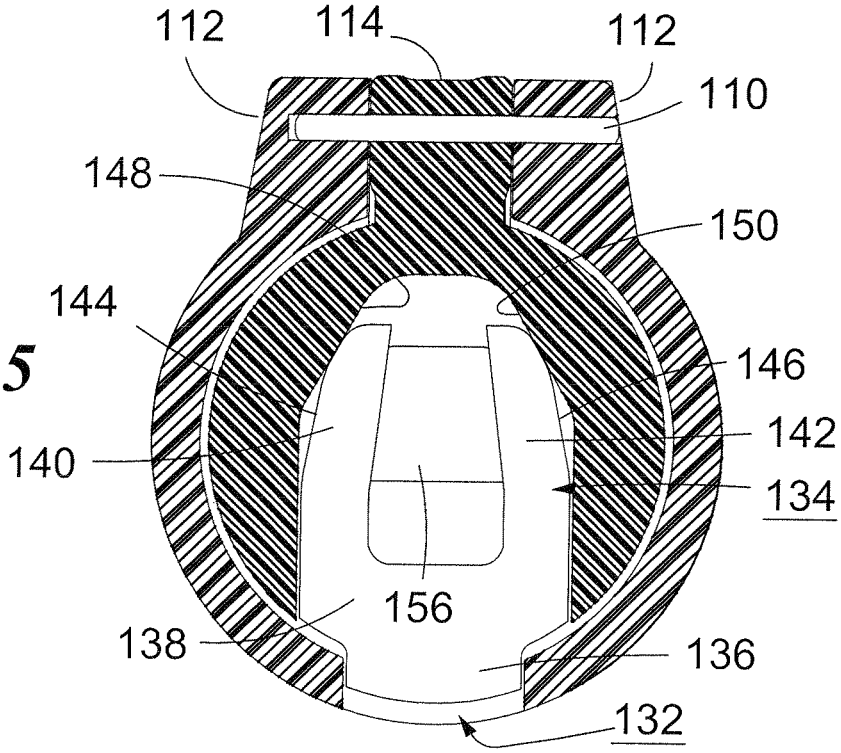

The embodiment depicted in FIGS. 4 and 5, can be similar to the embodiment of FIGS. 1-3 in all respects, except that, instead of having a battery compartment plug that also serves as a lock-out switch, the housing is provided with a hinged battery compartment door having a unique latch mechanism.

As shown in FIG. 5, an electrochemical current source 100 is disposed in a compartment 102 in a housing 104, which is generally similar to housing 10 in FIGS. 1 and 3, except that it lacks the plug-receiving features such as the notched slots 88 and 90. An opening 106 is provided at an end of the housing for insertion and removal of the electrochemical source 100. A door 108 is connected to the housing by a hinge (FIG. 5) comprising a pin 110, extending across the gap between a pair of ears 112 on the housing and through a knuckle 114 on the door. The door is shown in a closed condition, in which an annular part 116 of the door fits into opening 106. A resilient sealing ring 118, which sits in an annular groove 120 on the outer peripheral surface of part 116, and which moves with the door, fits into an annular mating groove 122 in the opening 106 when the door is in its closed condition to establish a fluid-tight seal to prevent moisture from entering compartment 102.

The door carries a coil spring 124 for engaging the negative terminal of the electrochemical current source. This spring also makes an electrical connection to a contact 126, which is connected to a current-carrying strip 128. A stop 130 limits movement of the door in the closing direction. The door 108 can be swung to a fully open position for removal of the electrochemical current source 100.

The door is maintained in a closed condition by a latch that comprises a slot 132 formed on a part of the housing that extends beyond the opening 106, and a movable latch part 134, mounted for sliding movement in the door and having a protrusion 136 that is received in the slot 132.

The movable latch part 134 comprises a cross member 138 from which the protrusion 136 extends in a first direction, and a pair of resilient legs 140 and 142 that extend from the cross member in a second direction opposite to the first direction. The legs are disposed in opposed, spaced relation to each other. The movable latch part has a pair of outwardly facing surfaces composed of an outer surface 144 on leg 140 and an outer surface 146 on leg 142. Surface 144 faces away from leg 142 and surface 146 faces away from leg 140. The movable latch part can be a unitary molded part. That is, the cross-member 138, the legs 140 and 142, and the latching protrusion 132 can be molded as a unit from any suitable resilient plastic resin.

A guide formed in the door constrains the movable latch part for linear movement relative to the door along the aforementioned first and second directions. The guide includes a pair of spaced, opposed, inwardly facing surfaces 148 and 150, respectively engaged with the outwardly facing surfaces 144 and 146 of the movable latch part. The inwardly facing surfaces of the guide exert inward forces on the legs causing the legs to be bent resiliently toward each other. In the embodiment shown in FIG. 5, outer surfaces 144 and 146 on the legs of the movable latch part are disposed in oblique relation to the direction of movement of the movable latch part such that the forces exerted on the legs of the latch part by the inwardly facing surfaces of the guide exert a camming action, producing a resultant force that urges the movable latch part in the first direction such that its protrusion is maintained in the slot. The inwardly facing surfaces 148 and 150 of the guide are also disposed in oblique relation to the direction of movement of the guide such that the resultant force urges the movable latch part in the first direction. Although surfaces 144, 146, 148 and 150 are all oblique in the embodiment illustrated in FIGS. 4 and 5, a similar result can be achieved if only surfaces 144 and 146 are oblique, or if only surfaces 148 and 150 are oblique.

A slide 152, extending through the door and having a manually engageable surface 154, has an upstanding part 156 that engages both legs of the movable latch part. As shown in FIG. 4, upstanding part 156 and the legs of the movable latch part are disposed between internal walls 158 and 160 formed in the door. The slide also has a downwardly protruding part 162 engaged with the cross-member 138 of the movable latch part. The downwardly protruding part and cross-member 138 are similarly disposed between internal walls 158 and 160. Because the spacing of walls 158 and 160 is only slightly greater than the sum of the thickness of the movable latch part and the maximum thickness of either of parts 156 and 162, the movable latch part 134 and the slide 152 are constrained so that they move only along the first and second directions.

An upwardly facing surface 166 of the slide engages the bottom of a projection 168 of the movable latch part so that, when the slide is pushed upward manually, the movable latch part moves in its second direction, against the resultant force exerted on the latch part as a result of the resiliency of its legs, so that protrusion 136 is released from slot 132, allowing the door 108 to be opened.

Many modifications can be made to the lighting apparatus described. For example, in the first embodiment, although two circumferential slots are used to receive opposite ends of the pin, a similar function can be achieved using a pin having a single protruding end and a single circumferential slot. The order of the three rotational positions of the plug can be modified. For example, the lock-out position in which the illumination source is disabled can be one of the end positions rather than the intermediate position. As mentioned previously, the number and kind of LEDs can be varied, as can the configuration of the mounting element. Although a single cell is preferable, plural electrochemical cells can be used to supply electric current, and the plural cells, if used, can be arranged in any of various ways.

In the embodiment shown in FIGS. 4 and 5, whereas the legs of the movable latch part are urged inward by inwardly facing surfaces of the guide, it is possible to achieve a similar result in a modification in which the legs of the movable latch part are urged outward by a guide element located between the legs.

Still other modifications can be made without departing from the scope of the invention as defined in the following claims.

What is claimed is:

1. A lighting apparatus comprising:

a housing having a compartment containing an electrochemical source of electric current;

an illumination source connected to the housing;

a control connected to the housing for switching electric current supplied by an electrochemical source within said compartment to the illumination source;

an arm structure comprising first and second arms fixed to the housing and extending therefrom in spaced, substantially parallel, relation to each other;

a mounting element for engaging a supporting rail, the mounting element being connected to said arm structure, on a first side of thereof, at a location spaced from the housing;

wherein said control includes a switch supported by said arm structure and disposed between said arms, the switch including a push-button recessed from a second side of said arm structure opposite from said first side and manually accessible for operation by insertion of a finger into a space between said arms, and electrical connections between said switch and the housing for delivery of electric current from the electrochemical source, through the switch, to the illumination source.

2. A lighting apparatus according to claim 1, in which said arm structure, the mounting element, and the switch together define a water-tight, sealed, compartment, said compartment containing at least parts of said electrical connections.

3. A lighting apparatus according to claim 1, in which said arm structure, the mounting element, and the switch together define a water-tight sealed compartment, said compartment containing at least parts of said electrical connections, and in which the mounting element is in the form of a plate attached to said arm structure, and forms a closure for said compartment.

4. A lighting apparatus according to claim 1, in which the housing is substantially in the shape of an elongated circular cylinder, in which the illumination source is connected to the housing at one end of the cylinder, in which the electrochemical source is an electrochemical cell located within the housing, and in which the control includes a second switch located at an opposite end of the cylinder, the second switch having a first position in which delivery of electric current to the illumination source is permitted and a second position in which delivery of electric current to the illumination source is disabled.

5. A lighting apparatus according to claim 1, in which the housing is substantially in the shape of an elongated circular cylinder, in which the illumination source is connected to the housing at one end of the cylinder, in which the cylinder has a removable plug at its end opposite from said one end, in which said electrochemical source is an electrochemical cell located within the housing, in which a spring, mounted on the plug is in contact with the electrochemical cell, and in which the control includes a second switch, the second switch being constituted by a first contact fixed to the plug and connected to the spring, and a second contact fixed to the cylinder, the plug including being rotatable and including a radial pin cooperating with a circumferential slot in the cylinder, the slot having an opening for allowing axial passage of said pin for removal and attachment of the plug when the plug is rotated to a first rotational position, a first detent for engaging the pin and thereby holding the plug against rotation when the plug is rotated to a second rotational position, and a second detent for engaging the pin and thereby holding the plug against rotation when the plug is rotated to a third rotational position, in which said contact fixed to the plug and said contact fixed to the cylinder are in contact with each other when the plug is in said third rotational position, and out of contact with each other when the plug is in said second rotational position, the pin being disengageable from said detents for rotation by movement along an axis extending from one end of the cylinder to the other end of the cylinder.

6. A lighting apparatus according to claim 1, in which the housing is substantially in the shape of an elongated circular cylinder, in which the illumination source is connected to the housing at one end of the cylinder, in which the cylinder has a removable plug at its end opposite from said one end, in which said electrochemical source is an electrochemical cell located within the housing, in which a spring, mounted on the plug is in contact with the electrochemical cell, and in which the control includes a second switch, the second switch being constituted by a first contact fixed to the plug and connected to the spring, and a second contact fixed to the cylinder, the plug including being rotatable and including a radial pin cooperating with a circumferential slot in the cylinder, the slot having an opening for allowing axial passage of said pin for removal and attachment of the plug when the plug is rotated to a first rotational position, a first detent for engaging the pin and thereby holding the plug against rotation when the plug is rotated to a second rotational position, and a second detent for engaging the pin and thereby holding the plug against rotation when the plug is rotated to a third rotational position, in which said contact fixed to the plug and said contact fixed to the cylinder are in contact with each other when the plug is in said third rotational position, and out of contact with each other when the plug is in said second rotational position, the pin being disengageable from said detents for rotation by movement along an axis extending from one end of the cylinder to the other end of the cylinder against an axial force exerted by said spring.

7. A lighting apparatus according to claim 1, in which the illumination source comprises plural light-emitting diodes.

8. A lighting apparatus according to claim 1, in which the illumination source comprises plural light-emitting diodes in a head connected to the housing by a flexible neck.

9. A lighting apparatus according to claim 1, including a flexible locking tab disposed between said arms for engaging a locking notch on a supporting rail to prevent movement of the lighting apparatus along the rail.

10. A lighting apparatus according to claim 1, in which cross-sections of the mounting element transverse to a first direction have an external dovetail-shaped cross-section capable of sliding engagement with an undercut dovetail-shaped slot in a rail.

11. A lighting apparatus according to claim 1, including:

an opening in the housing for insertion and removal of the electrochemical source respectively into and from said compartment;

a door hinged to said housing for closing said opening;

a latch for maintaining the door in a closed condition, the latch comprising a slot formed on a part of said housing, and a movable latch part mounted for sliding movement in said door and having a protrusion extending in a first direction relative to said door and receivable in said slot, wherein the movable latch part comprises a pair of resilient legs extending along a second direction opposite to said first direction in opposed, spaced relation to each other, said movable latch part having a pair of oppositely facing surfaces each composed of surface on one of said legs; and a guide formed in said door for constraining the movable latch part for linear movement relative to said door along said first and second directions, said guide including a pair of surfaces respectively engaged with said oppositely facing surfaces of the movable latch part;

wherein said surfaces of the guide exert forces on said legs causing said legs to be bent resiliently, and wherein at least the surfaces of one of said pairs of surfaces are disposed in oblique relation to said first and second directions such that said forces produce a resultant force urging said movable latch part in said first direction such that said protrusion is maintained in said slot; and said lighting apparatus including a manually operable slide, extending through said door, and engageable with the movable latch part for urging the movable latch part in said second direction against said resultant force, for releasing the protrusion from said slot.

12. A lighting apparatus according to claim 11, wherein said oppositely facing surfaces of the leg face away from each other, wherein said surfaces of the guide face toward each other, and wherein said surfaces of the guide exert inward forces on said legs causing said legs to be bent resiliently toward each other.

13. A lighting apparatus according to claim 11, in which said movable latch part is a unitary molded part.

14. A lighting apparatus according to claim 11, including a sealing ring fitting an interface between the door and the housing at the location of said opening when the door is in a closed condition, said ring providing a fluid-tight seal between the door and the housing.

15. A lighting apparatus according to claim 14, wherein the sealing ring is disposed in an annular groove formed in a circumferential surface of the door, and is movable with the door.

16. A lighting apparatus comprising:

a housing having a compartment containing an electrochemical source of electric current;

an illumination source connected to the housing;

a control connected to the housing for switching electric current supplied by an electrochemical source within said compartment to the illumination source;

an opening in the housing for insertion and removal of the electrochemical source respectively into and from said compartment;

a door hinged to said housing for closing said opening;

a latch for maintaining the door in a closed condition, the latch comprising a slot formed on a part of said housing, and a movable latch part mounted for sliding movement in said door and having a protrusion extending in a first direction relative to said door and receivable in said slot, wherein the movable latch part comprises a pair of resilient legs extending along a second direction opposite to said first direction in opposed, spaced relation to each other, said movable latch part having a pair of oppositely facing surfaces each composed of surface on one of said legs; and a guide formed in said door for constraining the movable latch part for linear movement relative to said door along said first and second directions, said guide including a pair of surfaces respectively engaged with said oppositely facing surfaces of the movable latch part;

wherein said surfaces of the guide exert forces on said legs causing said legs to be bent resiliently, and wherein at least the surfaces of one of said pairs of surfaces are disposed in oblique relation to said first and second directions such that said forces produce a resultant force urging said movable latch part in said first direction such that said protrusion is maintained in said slot; and said lighting apparatus including a manually operable slide, extending through said door, and engageable with the movable latch part for urging the movable latch part in said second direction against said resultant force, for releasing the protrusion from said slot.

17. A lighting apparatus according to claim 16, wherein said oppositely facing surfaces of the leg face away from each other, wherein said surfaces of the guide face toward each other, and wherein said surfaces of the guide exert inward forces on said legs causing said legs to be bent resiliently toward each other.

18. A lighting apparatus according to claim 16, in which said movable latch part is a unitary molded part.

19. A lighting apparatus according to claim 16, including a sealing ring fitting an interface between the door and the housing at the location of said opening when the door is in a closed condition, said ring providing a fluid-tight seal between the door and the housing.

20. A lighting apparatus according to claim 19, wherein the sealing ring is disposed in an annular groove formed in a circumferential surface of the door, and is movable with the door.

* * * * *